US006896533B2

(12) United States Patent
Schubert et al.

(10) Patent No.: US 6,896,533 B2
(45) Date of Patent: May 24, 2005

(54) SAFETY MAT CONNECTOR APPARATUS AND METHOD

(75) Inventors: Louis L. Schubert, San Jose, CA (US); Joseph Borjon, Livermore, CA (US); Boris Shteynberg, San Francisco, CA (US); Vladimir Belfor, San Francisco, CA (US)

(73) Assignee: Scientific Technologies Incorporated, Fremont, CA (US)

( * ) Notice: Subject to any disclaimer, the term of this patent is extended or adjusted under 35 U.S.C. 154(b) by 0 days.

(21) Appl. No.: 10/461,579

(22) Filed: Jun. 13, 2003

(65) Prior Publication Data

US 2004/0253861 A1 Dec. 16, 2004

(51) Int. Cl.[7] ..... H01R 4/60

(52) U.S. Cl. ..... 439/206; 439/660; 200/86; 307/119

(58) Field of Search ..... 439/660, 206; 200/86; 307/119

(56) References Cited

U.S. PATENT DOCUMENTS 4,585,922 A * 4/1986 Berenson ..... 219/212
5,448,232 A 9/1995 Tyburski
5,602,428 A * 2/1997 Schultz et al. ..... 307/119
5,990,799 A 11/1999 Boon et al.
6,054,658 A * 4/2000 Duhon et al. ..... 200/86 R
2003/0000815 A1 1/2003 Burgess

OTHER PUBLICATIONS

Larco; Quick Connect Tab/Cord System; 1 pg.
Larco; Industrial Safety Mat Accessories; 1 pg.

* cited by examiner

*Primary Examiner*—Truc T. Nguyen
(74) *Attorney, Agent, or Firm*—Coats & Bennett, P.L.L.C.

(57) ABSTRACT

A pressure-sensitive mat system includes a mat with a recessed mat connector and a cable assembly that includes a cable connector that detachably mates to the mat connector. The cable connector is sized to the inset area of the mat connector and thus conforms to the dimensional envelope of the mat. Conforming to the mat's dimensional envelope minimizes tripping hazards, reduces the likelihood of cable damage, and permits the use of flush fitting edge trim strips that may be used to secure the mat to the floor. In one embodiment, the cable connector mounts to the mat connector via threaded fasteners. The use of threaded fasteners permits compressive connector engagement, which enhances inter-connector electrical contact integrity and permits the use of an interposed connector gasket that provides watertight sealing when the two connectors are compressively engaged. The connector(s) may include other features such as air vents to vent the mat interior.

17 Claims, 10 Drawing Sheets

SAFETY MAT CONNECTOR APPARATUS AND METHOD

BACKGROUND OF THE INVENTION

The present invention generally relates to pressure-sensitive mats and particularly relates to pressure-sensitive mat systems that include detachable mat cables.

A typical pressure-sensitive mat includes one or more normally separated electrode pairs encased in a sealed, flexible material. Downward force on the mat's upper surface forces the electrodes into contact with each other, which causes an electrical "closure" through the normally open mat electrodes. Some mats include one large electrode pair comprising vertically stacked upper and lower conductive sheets separated by one or more compressible spacers, while other mats include multiple, smaller electrode pairs. Of course, other sensing technologies may be used, such as resistive or capacitive sensing, but the underlying weight-based actuation principle remains essentially unchanged across mat varieties.

Pressure-sensitive mats find use in a variety of applications, ranging from automatic door actuation to hazardous machine guarding. In that latter context, such mats often are referred to as "safety mats." Typically, safety mats cover the floor areas in and around dangerous work locations and thus provide a reliable and robust mechanism for detecting the presence of persons or vehicle in those locations. For example, a safety mat may be electrically wired to a "mat controller" that is configured to shut down hazardous equipment upon sensing a closure of the mat's electrodes. Safety mats also may be used to ensure that an operator remains in a safe operating location by placing a mat at the designated location and configuring an associated mat controller to permit machine operation only when weight is sensed at that location.

Conventionally, rigid perimeter frames (mat trim pieces) fasten to the floor and hold mats in place, i.e., the frames prevent the positioned mats from sliding or shifting from their desired floor locations. Such frames may be beveled to minimize the tripping hazard posed by mat edges, and may provide for joining smaller mats into a larger mat grid. In such applications, the trim strips themselves may be "active" in that they provide for pressure sensing along the seams between adjacent mats. Active trim strips eliminate or at least minimize "dead" areas between co-joined mats. Trim strips also may include internal cable raceways that allow mat cables to be routed within them. Such internal routing further reduces tripping hazards and provides significant protection for the cables that interconnect the mats to the mat controller(s).

To complement the almost universal use of mat trim strips, mat cables normally are permanently connected to the mats in a manner that minimizes cable termination protuberances along mat edges. Molding the mat-to-cable termination into the mat itself avoids the need for bulky cable terminations at the mat's edge, e.g., terminal blocks or the like, that would disrupt the mat's dimensional envelope and thus prevent the use of edgewise flush mat trim strips.

Integrally molded mat-to-cable terminations offer additional advantages, such as the opportunity to securely attach the cable wires to the mat's internal electrodes via connections made within the mat's sealed body. Such connections inherently are watertight, assuming that the molded cable inlet is sealed. Further, internal connections inherently are less vulnerable to damage because they are isolated from the foot and vehicle traffic to which the mat's exterior is exposed.

However, substantial disadvantages accompany the use of integral mat cables. For example, mat purchasers usually must order mats based on the desired cable length and, in turn, mat manufacturers usually must stock mats having many different cable lengths, or be prepared to custom-fill orders based on the requested cable length. Of course, mat cables may be cut or spliced, but such modifications decrease the overall safety integrity of mat systems by adding additional connection failure points that are vulnerable to mechanical damage, water ingress, corrosion, etc.

An ideal pressure-sensitive mat system would combine the advantages of integral cables with those of detachable cables, while simultaneously avoiding the attendant mechanical and safety disadvantages of detachable cable connections. With that approach, the manufacturing and use of pressure-sensitive mats would be simplified because the cable length variable would be independent of the basic mat configuration. Mats could then be manufactured and ordered according to desired mat sizes without regard to the widely varying lengths of mat cables used in particular installations. Further advantages would be gained in that mats and mat cables become independently replaceable items, thereby simplifying maintenance and repair of mat systems.

SUMMARY OF THE INVENTION

The present invention comprises a pressure-sensitive mat system that includes a pressure-sensitive mat having a recessed mat connector and a detachable cable assembly that includes a cable connector that is sized to fit within the inset area of the mat connector when mounted to it. In one or more embodiments, the mat connector includes threaded mounting holes so that the cable connector can be mated with the mat connector using threaded fasteners. The use of threaded fasteners provides compressive engagement between the cable and mat connectors and thus allows a mounting gasket interposed between cable and mat connector mounting faces to provide watertight sealing of at least a portion of the mated connector faces, such as by sealing at least those portions of the mating faces that include the electrical contacts.

The compressive engagement force also may be used to compress spring contacts within one or both the mat and cable connectors to provide high-integrity electrical connections between the mated mat and cable connectors. Of course, the present invention contemplates the use of other compressive fastening apparatus, such as snaps or spring clips that may be used to detachably bias the cable connector into compressive engagement with the mat connector.

In an exemplary embodiment, the mat comprises a molded exterior covering that encases upper and lower mat electrodes that are spaced apart using one or more compressible spacers. The covering, which may be a flexible PVC material, includes at least one inset area, preferably along a mat edge. In which the mat connector is positioned. A mat may have more than one mat connector to support multiple mat-to-controller or mat-to-mat connections. At each mat connector location, the mat electrodes include tabbed projections, or other attachment features, to which a mat connector may be mounted. In one or more exemplary embodiments, the mat connector includes tab insets that slip onto, or otherwise receive, the electrode tabs. Set screws or other fastening mechanisms then may be used to secure the mat connector to the electrodes. This arrangement may be implemented using a molded connector body that includes an internally fixed contact block for each electrode tab, wherein each contact block receives a corresponding electrode tab.

Once the mat connector is secured to the mat electrodes, the exterior covering of the mat may be molded over the mat electrodes and a portion of the mat connector, leaving a sealed mat with a partially exposed but recessed mat connector. Of course, the present invention contemplates other fastening and sealing arrangements. However, the ability to pre-attach the mat connector to the electrodes prior to overmolding the mat's exterior cover enhances the molding process inasmuch as mats can be molded without any attached cables, which cables would otherwise introduce cooling and mold construction challenges.

Complementing the above arrangement, an exemplary detachable cable assembly includes a cable with a cable connector on at least one cable end. The cable connector is sized such that it fits within the inset area of the recessed mat connector when it is mounted to the mat connector. By sizing the cable connector in this manner, it remains within the dimensional envelope of the mat when it is mounted to the mat connector, i.e., it does not project beyond the top/bottom/edge surfaces of the mat when mated. By remaining within the mars dimensional envelope, the mat's surface profile is preserved, which allows the mat to be used with trim strips, i.e., perimeter frames that are used to fix the mat to a specified floor location. Thus, the present invention permits the simultaneous use of detachable mat cable assemblies and flush trim strips. Further, by remaining within the dimensional envelope of the mat, the detachable cable assembly does not present a tripping hazard, nor does it leave the attached cable vulnerable to damage.

An exemplary cable connector includes spring contact fingers that exert a contact bias force when the cable connector is mated to the mat connector. By including threaded mounting holes in the mat connector, threaded fasteners may be used to mount the cable connector and thereby gain the desired compressive force on the spring contacts. Additionally, a gasket may be interposed between the connector mating faces of the mat and cable connectors to provide watertight sealing of the inter-connector electrical connections when the cable connector is mounted to the mat connector. Again, the ability to compressively engage the mat connector via screw-down mounting facilitates achieving a watertight connection between the mat and cable connectors. The gasket may be separate from both connectors, or may be carried on a connector mating face of either the mat or cable connector.

Other advantages and features are offered in the various embodiments of the present invention. For example, at least one embodiment of the mat connector includes a vent that provides an opening into the mat's interior. Inclusion of the vent permits the mat to "breathe," which may be important in circumstances where the mat undergoes significant changes in ambient pressure. For example, a completely sealed mat may suffer undesirable expansion when transported on commercial aircraft, which expansion is avoided with the vented mat of the present invention. Further, by terminating the vent within a mounting hole of the mat connector, the vent may be sealed for watertight operation simply by mounting the mat connector. In other words, an exemplary mat may be vented for ease of storage and shipment and yet sealed for watertight operation once placed into operation.

Of course, the present invention is not limited to features and advantages noted above. Those skilled in the art will recognize other features and advantages upon reading the following detailed descriptions, and upon viewing the accompanying exemplary drawings in which like elements are denoted by like reference numbers.

DETAILED DESCRIPTION OF THE INVENTION

Figure 1:
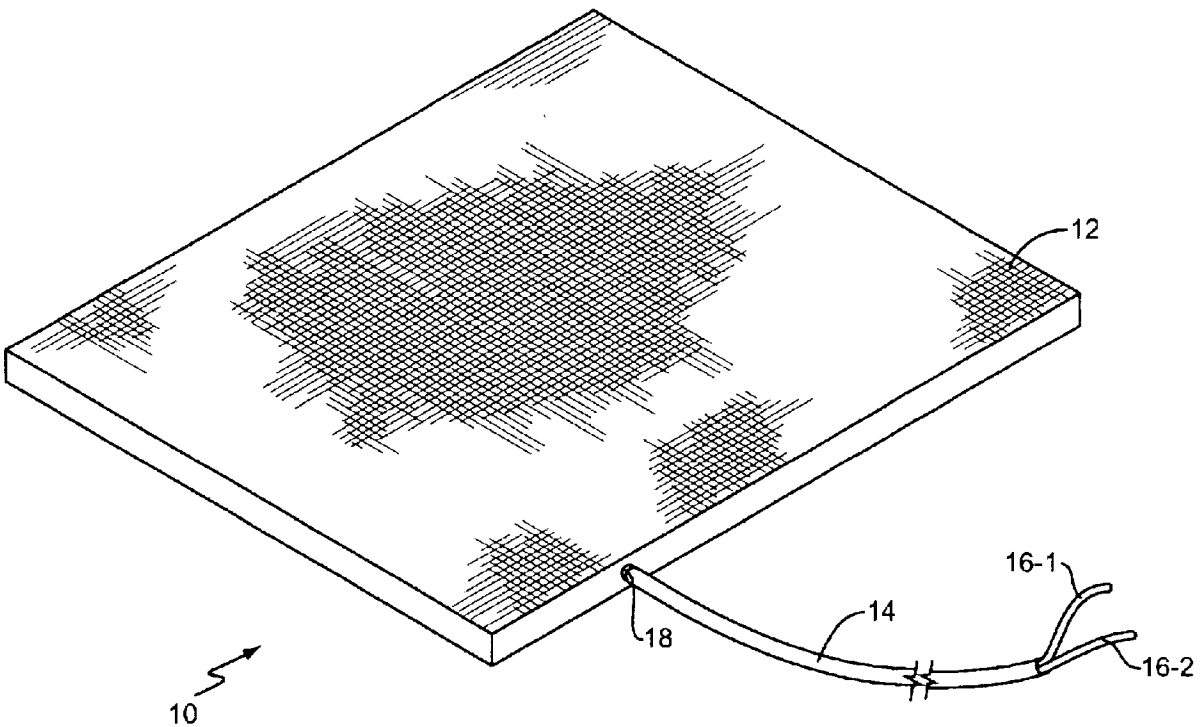
PRIOR ART FIG. 1
FIG. 1 is a diagram of a typical mat system that includes a permanently attached mat cable.

FIG. 1 illustrates a conventional pressure-sensitive mat system 10 that includes a mat 12 that includes an integrally attached cable 14 with one or more conductors 16 and a molded-in strain relief 18. Pressure-sensitive mat 12 may be placed at a strategic area on a floor to detect foot and vehicle traffic. As such, pressure-sensitive mats commonly are used as "presence sensing" devices in automatic door applications and, more importantly, in hazardous machine guarding applications.

Figure 2:
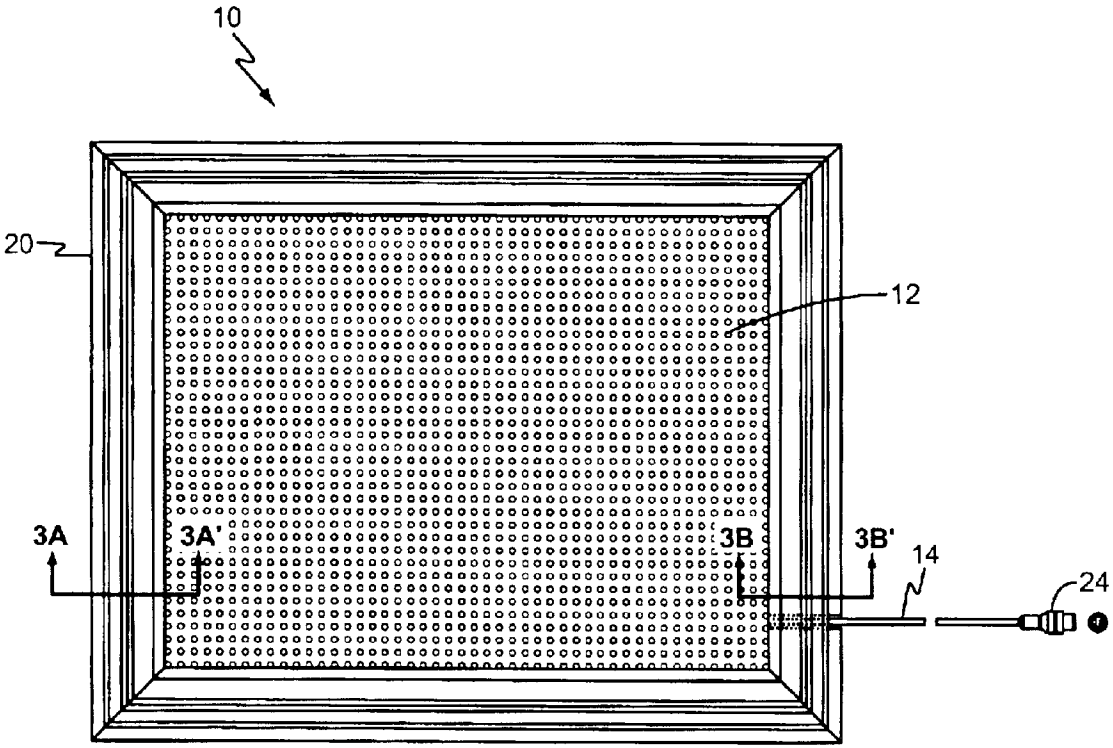
PRIOR ART FIG. 2
FIG. 2 is a diagram of a typical mat system with perimeter trim strips.

Molded mat 12 with cable 14 pre-attached to it provides an inherently robust and watertight interconnection between mat 12 and cable 14. Of further benefit, use of the integrally molded cable 14 results in little or no disruption of the mat's dimensional envelope, i.e., no cable connector projects beyond the mars top, bottom, or edgewise surfaces. The advantages of this relatively flush, compact cable connection are apparent in FIG. 2, which illustrates mat 12 being surrounded by a perimeter frame 20.

Figure 3A:
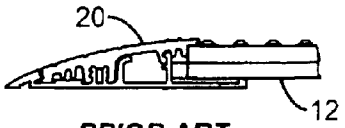
PRIOR ART FIG. 3A
FIGS. 3A and 3B are cross sectional views of the trim strips illustrated in FIG. 2.
Figure 3B:
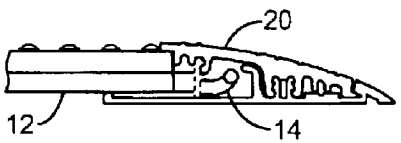
PRIOR ART FIG. 3B

Because mats represent a potential tripping hazard, and further because oftentimes a given mat must remain at a fixed location on an otherwise open floor, perimeter frames 20 serve the twofold purpose of providing a finished and potentially beveled ramp to prevent tripping from the mars edge, and further provide a mechanism for securely retaining mat 12 at a fixed floor location. FIGS. 3A and 3B are cross sectional views of perimeter frame 20 and illustrate how frame 20 is used to capture and retain mat 12.

Particularly in FIG. 3B, one sees that the mat cable 14 fits within an interior channel or void formed by the perimeter frame 20 and, moreover, that perimeter frame 20 essentially abuts the mat edge thereby leaving little or no room for cable connection protrusions.

Figure 4:
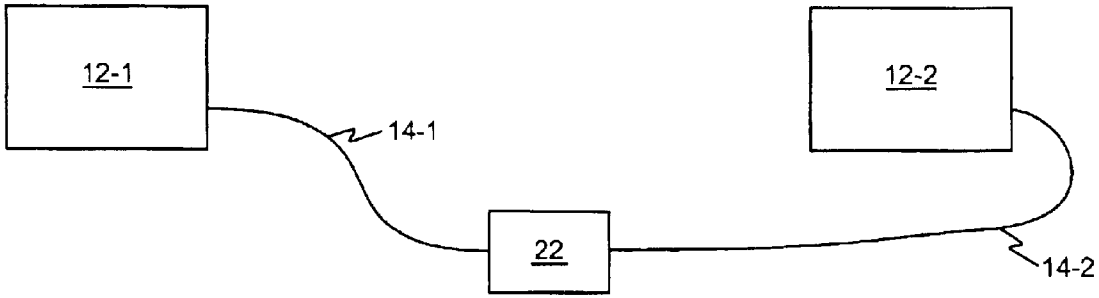
PRIOR ART FIG. 4
FIGS. 4 and 5 are diagrams illustrating the use of differing lengths of permanently attached mat cables in typical mat installations.
Figure 5:
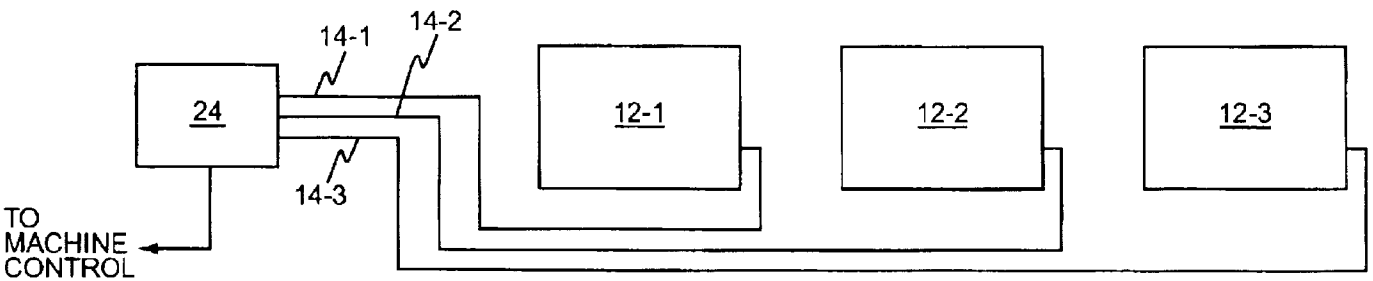
PRIOR ART FIG. 5

While use of integral cables has distinct advantages with respect to connection robustness and water tightness, FIGS. 4 and 5 illustrate some of the many disadvantages associated with these integral cables. In FIG. 4, for example, two pressure-sensitive mats, mats 12-1 and 12-2, are interconnected with a monitoring system 22 via integral mat cables 14-1 and 14-2. As previously explained, each mat 12 ordinarily is fixed to a specific floor location relative to control unit 22 and therefore the lengths of cables 14-1 and 14-2 are determined by the distance of the overall cable routing path lengths from each mat 12 to the control unit 22. Thus, each mat 12 must be ordered based on the required cable length, or the mat installer must cut or splice mat cables as needed, assuming that the installation safety requirement permits such cable modifications, to obtain the correct cable length.

FIG. 5 further illustrates the problems of differing cable lengths. In this diagram, one notes that the lengths of cables 14-1 through 14-3 potentially are significantly different depending upon the relative placements of mats 12-1 through 12-3 with respect to controller 24. Thus, if mat 12-2 were damaged it is unlikely that either mat 12-1 or mat 12-3 would serve as a suitable replacement given the likely significant differences in cable lengths. Of course, mat cables 14 may be spliced or trimmed as needed but such operations introduce additional connections that generally require watertight sealing and represent added points of failure.

Figure 6:
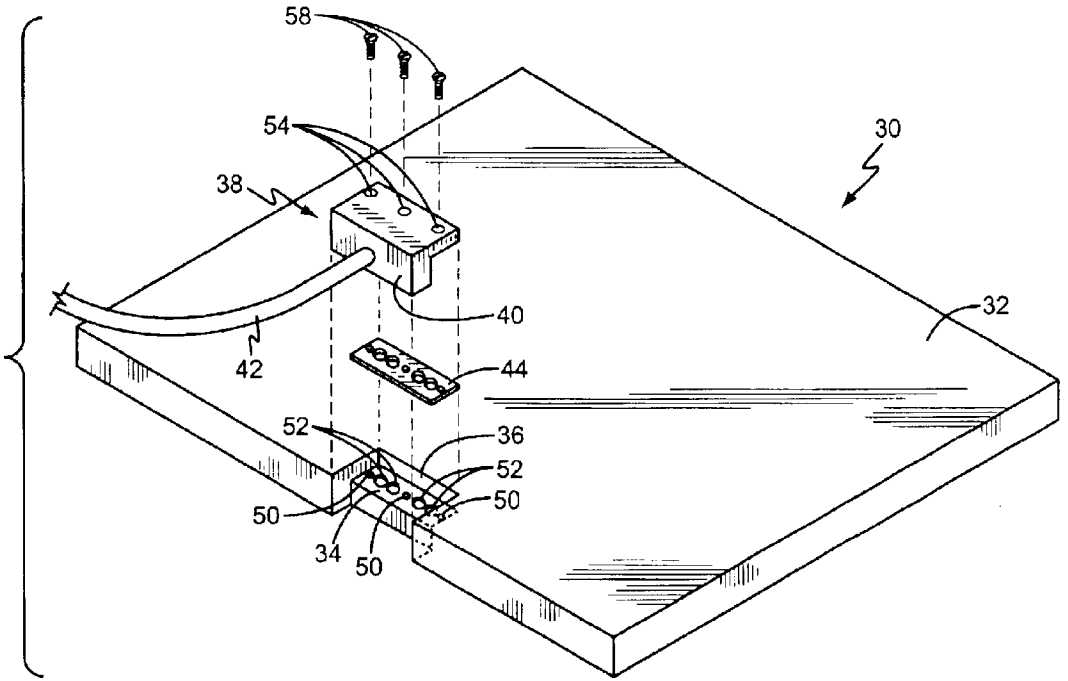
FIG. 6 is a diagram of an exemplary pressure-sensitive mat system according to the present invention, which includes an exemplary mat connector and detachable cable assembly that includes a cable connector to detachably mate with the mat connector.

Overcoming these and other problems, the pressure-sensitive mat system 30 of the present invention is illustrated in an exemplary embodiment in FIG. 6, which includes mat 32, mat connector 34 recessed within an inset area 36 of mat 32, detachable cable assembly 38 and its associated mat cable 42. An exemplary embodiment of the detachable cable assembly 38 includes a cable connector 40 to mate with mat connector 34, possibly using an optional sealing gasket 44 that is interposed between connector mating faces of mat connector 34 and cable connector 40. In some embodiments, gasket 44 comprises a separate item, while in other embodiments gasket 44 may be attached to the mating face of either mat connector 34 or cable connector 40. The gasket 44 may be a separate item or may be integrally attached to either the mat connector 34 or the cable connector 40. For example, gasket 44 may be pre-attached to one of the mating faces (i.e., to the mating face of either connector 34 or connector 40.)

In one or more embodiments, the mating face of mat connector 34 is at an elevation below that of the mat's top surface, and mat connector 34 may be recessed with respect to the mat's edge. This positioning of mat connector 34 offers a recess into which the cable connector 40 may be seated for flush interconnection with mat connector 34 when the two connectors are mated together in a manner that does not extend or project beyond the mat's dimensional envelope. Further, it should be noted that the terms "stop" and "bottom" as used herein should not be construed in any restrictive sense. For example, mat system 30 may be configured such that mat connector 34 is positioned in a manner that provides for mounting the cable connector 40 on the "bottom" side of mat 32 relative to the mars installed orientation.

Regardless, an exemplary interconnection configuration is based on the connector mating face of an exemplary mat connector 34 including one or, more mounting holes 50, and one or more electrical contacts 52, which provide electrical interconnection to the mat's internal electrode(s). Complementing this arrangement, an exemplary cable connector 40 includes one or more mounting holes 54 that align with mounting holes 50, and one or more electrical contacts (not shown) in the cable connector's connector mating face that mate with contacts 52 of mat connector 34. In at least one exemplary embodiment, threaded fasteners 58 may be used to mount cable connector 40 to mat connector 34. The use of threaded fasteners 58 permits compressive, high-integrity engagement of the cable connector 40 with the mat connector 34 and, for example, may be used to provide compressive force sufficient to seal the connector-to-connector electrical contacts via interposed gasket 44.

In other exemplary embodiments, cable 42 may include mat cable assemblies 38 at both cable ends for mat-to-mat interconnection. In still other embodiments, cable 42 may include a circular connector or other finished connector termination for attachment to a mat controller (not shown), or simply may include an unfinished cable end for access to the cable's internal conductors.

With the illustrated arrangement, end users may purchase and install the pressure-sensitive mats 32 independently of the detachable cable assemblies 38. In other words, the requirements to manufacture and purchase mats with permanently attached cables of pre-specified length, or to otherwise splice/trim fixed-length cables are eliminated. Significantly, the inventive connector design embodied in the present invention provides the flexibility inherent in a detachable cable system yet does not compromise mat connection integrity or, if desired, water tightness. Those skilled in the art should note that while one or more exemplary embodiments of the mat system 30 rely on the use of threaded fasteners 58 to provide secure connector mating, other detachable arrangements are contemplated by the present invention, such as the use of recessed clips, snaps, etc.

Figure 7:
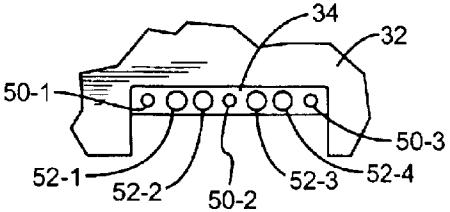
FIG. 7 is a top view of an exemplary mat connector.

FIG. 7 illustrates an exemplary mat connector 34 in more detail. Specifically, FIG. 7 provides a top view of mat connector 34 that illustrates the use of symmetrically spaced apart mounting holes 50-1, 50-2, and 50-3. Further, FIG. 7 illustrates a plurality of spaced apart contacts 52-1, 52-2, 52-3, and 52-4. The use of symmetrically spaced apart mounting holes provides a uniform compressive force between the cable-to-mat connector faces when the cable connector 40 is mounted to mat connector 34 via threaded fasteners 58.

Figure 9:
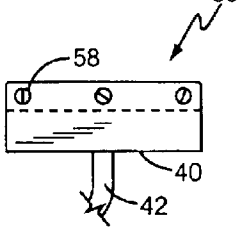
FIG. 9 is a top view of an exemplary cable connector.
Figure 10:
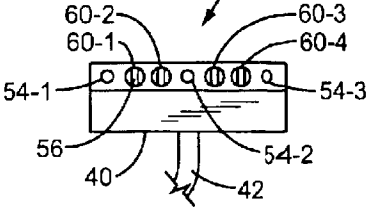
FIG. 10 is a bottom view of an exemplary cable connector.
Figure 8:
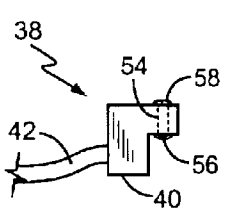
FIG. 8 is a side view of an exemplary cable connector.

FIGS. 8, 9, and 10 illustrate exemplary side, top, and bottom views of cable connector 40. For example, the side view in FIG. 8 illustrates threaded fastener 58 may be used to secure cable connector 40 to mat connector 34 and further illustrates that the electrical contacts of cable connector 40 may be configured as "spring contact fingers" 56 that are compressively engaged with the corresponding electrical contacts 52 of mat connector 34 when cable connector 40 is mated to mat connector 34.

Such an arrangement is more clearly illustrated in FIG. 10, which shows that a connector mating face on the underside of cable connector 40 includes one or more apertures 60 through which the electrical contacts 56 of the cable connector 40 may project. In the illustrated embodiment, there are four apertures 60-1 through 60-4, each one including a projecting spring contact 56. Each contact 56 may correspond to a separate electrical connection for mat 32, or two or more electrical contacts 56 may be used for a common electrical connection.

Figure 11:
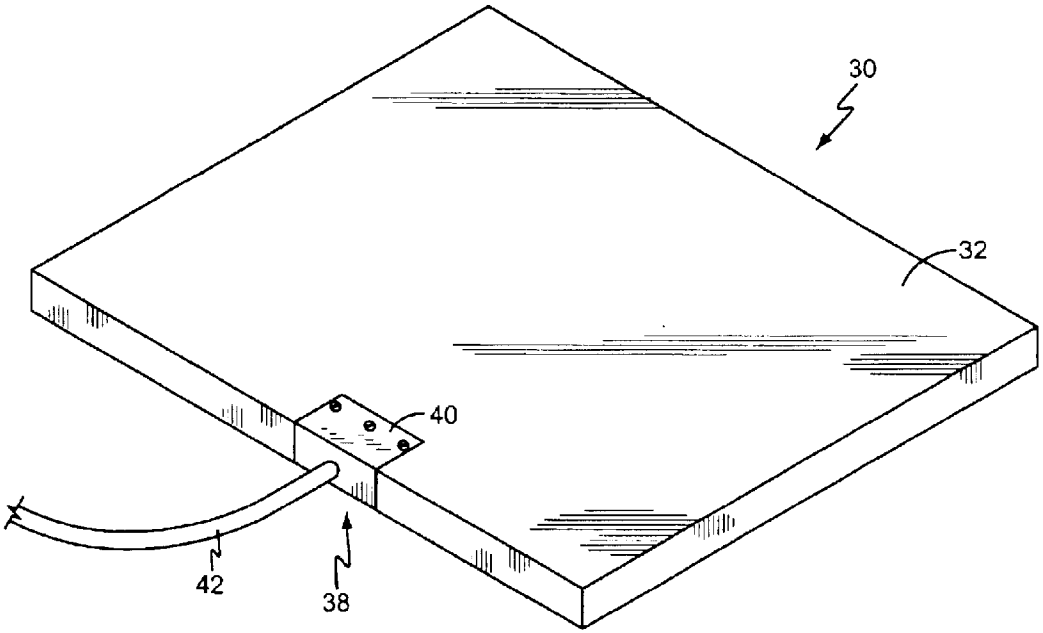
FIG. 11 is a perspective view of mated mat and cable connectors.

FIG. 11 illustrates an exemplary mat system 30 wherein the detachable cable assembly 38 is mounted to mat 32. Specifically, FIG. 11 illustrates cable connector 40 being mated with mat connector 34. In an exemplary embodiment, the cable connector 40 is sized to fit within the inset area 36 of mat 32 such that cable connector 40 conforms to the dimensional envelope of mat 32 when cable connector 40 is mated with mat connector 34.

Figure 12:
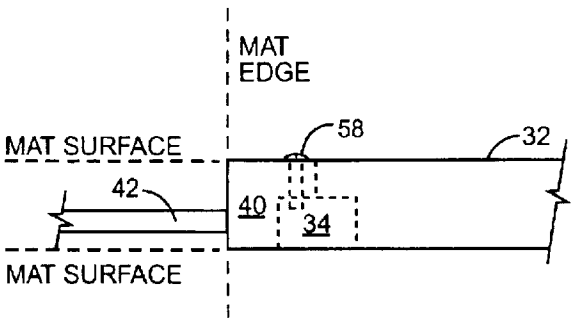
FIG. 12 is a side view of mated mat and cable connectors and illustrates that the mated cable connector remains within the dimensional envelope of the mat.

FIG. 12 presents a simplified illustration of such conformance. Because mat connector 34 is recessed within inset area 36 of mat 32, and because cable connector 40 is sized to substantially occupy the inset area 36 without projecting beyond the upper, lower, or edgewise surfaces of mat 32, the dimensional envelope of mat 32 is not interrupted by detachable cable assembly 38 when cable connector 40 is mounted to mat connector 34. The advantages of such dimensional conformance are many.

For example, any projection of connector 40 above the top surface of mat 32 would leave the detachable cable assembly 38 prone to damage, or inadvertent disconnection, and would present a potentially significant tripping hazard. Further, if cable connector 40 protruded beyond the edgewise surface of mat 32, the use of perimeter frames such as the earlier illustrated perimeter frame 20 would be seriously compromised.

Figure 13A:
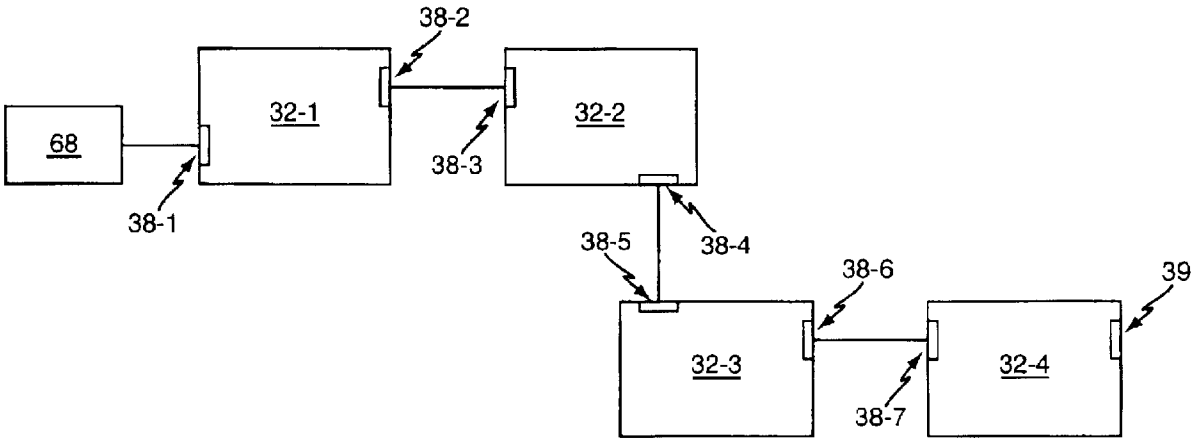
FIGS. 13A and 13B illustrate exemplary mat-to-mat and mat-to-controller wiring configurations using the mat system of the present invention.
Figure 13B:
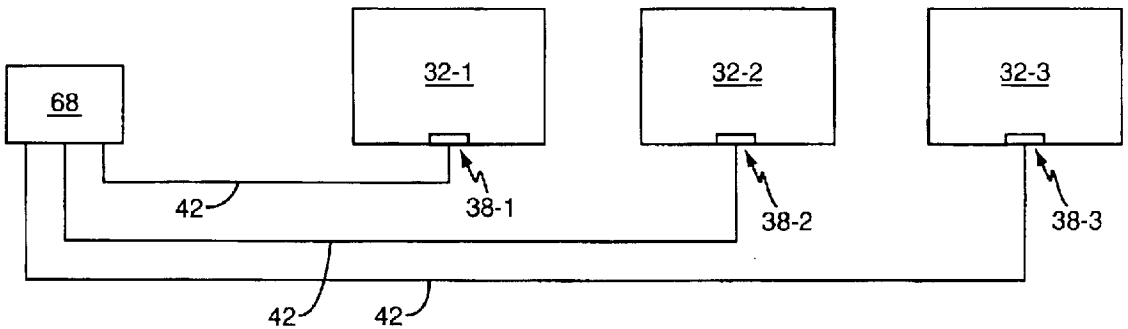

FIGS. 13A and 13B illustrate just some of the many advantages gained with the use of the detachable cable assembly 38. For example, FIG. 13A illustrates a "daisy chain" arrangement of mats 32-1 through 32-4, wherein the first mat interconnects to a mat controller 68 via one detachable cable assembly 38-1 and interconnects to the second mat, mat 32-2, via a cable 42 that includes detachable cable assembly 38-2 at one end and detachable cable assembly 38-3 at its other end. Similar daisy chain connections are made using detachable cable assemblies 38-4 through 38-7.

Note that "connection point flexibility" is one of the many advantages of the mat system 30 according to one or more embodiments of the present invention. That is, mat 32 can be molded with two or more "extra" mat connectors 34, that may be common to one side, positioned on opposite sides, etc. Any unused mat connector 34 can be covered/sealed using a "dummy" version of mat connector 40, shown as connector 39 attached to mat 32-4 in FIG. 13A. An exemplary dummy connector would include threaded mounting holes for mounting to (and sealing) any unused mat connector 34, but typically would not include any cable extension.

FIG. 13B illustrates another exemplary arrangement wherein mats 32-1 through 32-3 each are connected to a mat controller 68 via a separate detachable cable assembly 38. With this arrangement, the replacement of any given mat 32 or any given detachable cable assembly 38 does not require the replacement of both.

Figure 14A:
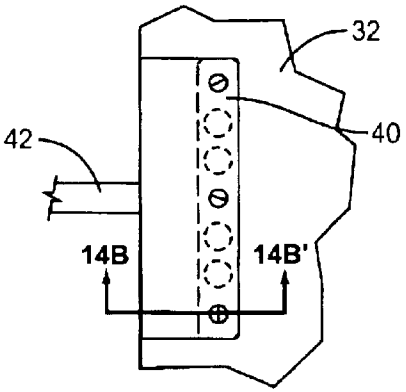
FIGS. 14A and 14B are top side and cross-sectional views, respectively, of exemplary mat and cable connector details.
Figure 14B:
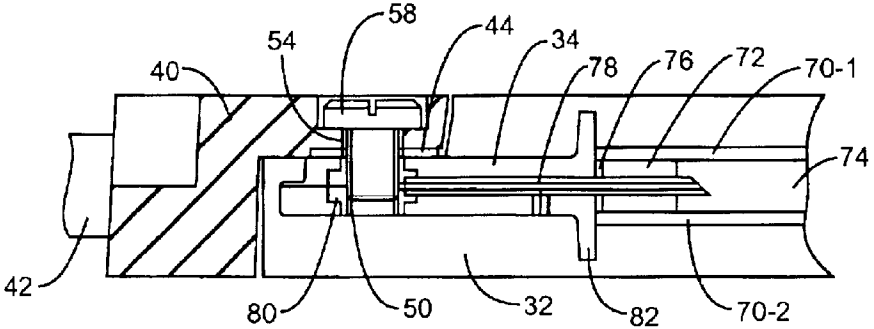

FIG. 14A illustrates the detailed cross sectional view taken in FIG. 14B for an exemplary mated cable and mat connector pair. In the illustration, one sees that mat 32 includes upper and lower electrodes 70-1 and 70-2 that in an exemplary embodiment are formed as vertically spaced apart top and bottom conductive plates that are pressed together into electrical contact responsive to force being exerted normal to the mat's exterior. To maintain the electrodes 70 in a normally open (non-contacting) configuration, the exemplary mat 32 further includes one or more flexible spacers 72. Further, one sees that mat connector 34 may be formed as a molded-in connector such that it is integrally formed into a perimeter of the molded mat material as part of the molding process. As part of that process, mat connector 34 may abut the electrode spacer 72 and sealant 76 may be used to further insure water tightness of the mat interior 74.

In other words, mat connector 34 can be pre-attached to electrodes 70, and then the entire assembly can be overmolded with molding material that forms the mat's final exterior covering. Polyvinylchloride (PVC) represents an exemplary compound for forming the molded mat exterior, but it should be understood that other materials may be used as needed or desired. Regardless, dummy connectors 39 can, if desired, provide an exemplary "plug" for use in the original molding of mat 32. Thus, to prevent ingress of molding material (i.e., the mat's exterior covering) into undesired areas of mat connector 34 during the mat molding process, the mat manufacturer would simply attach dummy cable connectors 39 to each mat connector 34 before molding the mat 32.

Molding mat 32 offers the advantage of completely encasing electrodes 70 in a watertight, flexible "skin." However, sometimes having a completely sealed mat interior 74 is a disadvantage. For example, if mat 32 is transported via commercial aircraft, it may experience an overpressure condition as a function of the mat 32 being exposed to a reduced ambient pressure. Such overpressure can deform and even damage mat 32 and thus at least one embodiment of mat connector 34 includes a vent in the form of a needle or port 7B that extends through the body of mat connector 34 and on into mat interior 74. In an exemplary arrangement, port 78 opens into a mounting hole 50 of mat connector 34 such that the mat interior 74 is vented to atmospheric pressure if cable connector 40 is not mounted but is sealed upon mounting cable connector 40 to mat connector 34 via threaded fasteners 58. In this manner, mat 32's interior 74 is vented to ambient pressure through mat connector 34 if cable connector 40 is not attached, and is sealed (watertight and airtight) if cable connector 40 is attached.

More specifically, mounting holes 50 of mat connector 34 may be threaded, such as by fixing a molded-in nut 80 within each mounting hole 50. In that case, port 78 may extend through one side of nut 80 such that a threaded interior wall of nut 80 is vented all the way into the mat interior 74. With that arrangement, gasket 44 may be interposed between the connector mating faces of cable connector 40 and mat connector 34 and compressively engaged by virtue of screwing down threaded fasteners 58 into mounting holes 50, which action thereby closes port 78 and seals mat interior 74.

Figure 15A:
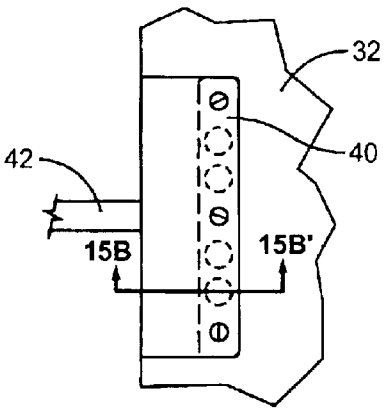
FIGS. 15A and 15B illustrate the mat and cable connectors of FIGS. 14A and 14B but along a different cut line.
Figure 15B:
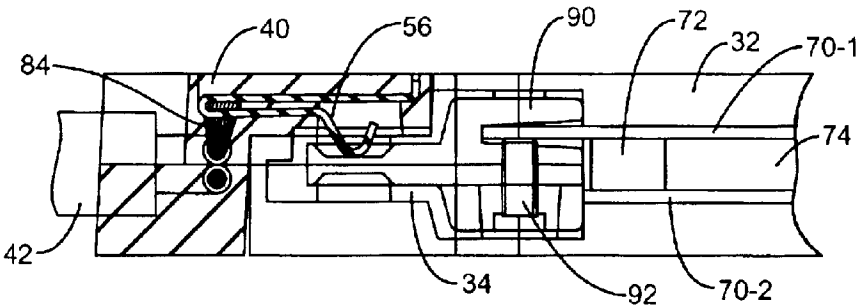

FIG. 15A illustrates the cross sectional view of mat connector 34 and mated cable connector 40 shown in FIG. 15B. As illustrated, an exemplary embodiment of mat connector 34 includes one or more solid contact blocks 90 that are molded within the body of mat connector 34 and which provide mechanical and electrical interconnection with the mat electrode 70. In an exemplary configuration, the mat connector body is a glass-filled nylon material that can be formed, i.e., molded around contact blocks 90 to form a combined plastic/metal connector assembly. Other items, such as the nut 80 also can be molded into the body of mat connector 34.

With the above configuration, the spring contacts 56 of cable connector 40 electrically interconnect with the mat's interior electrodes 70 via contact with connector blocks 90 when cable connector 40 is mounted to mat connector 34. Further, one sees in the illustration an exemplary arrangement for securing mat connector 34 to the electrodes 70 prior to overmolding the electrodes 70 and mat connector 34 with a flexible material to form the completed mat 32. More specifically, one or more set-screws 92 are used to forcibly engage the contact blocks 90 with the respective mat electrodes.

Figure 17:
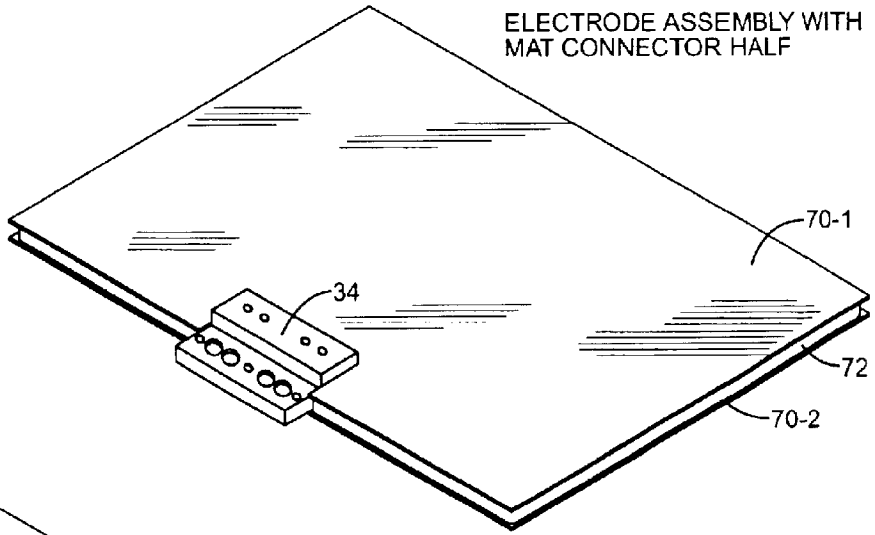
FIG. 17 is a diagram of an exemplary mat connector shown after attachment to the exemplary mat electrodes.
Figure 16:
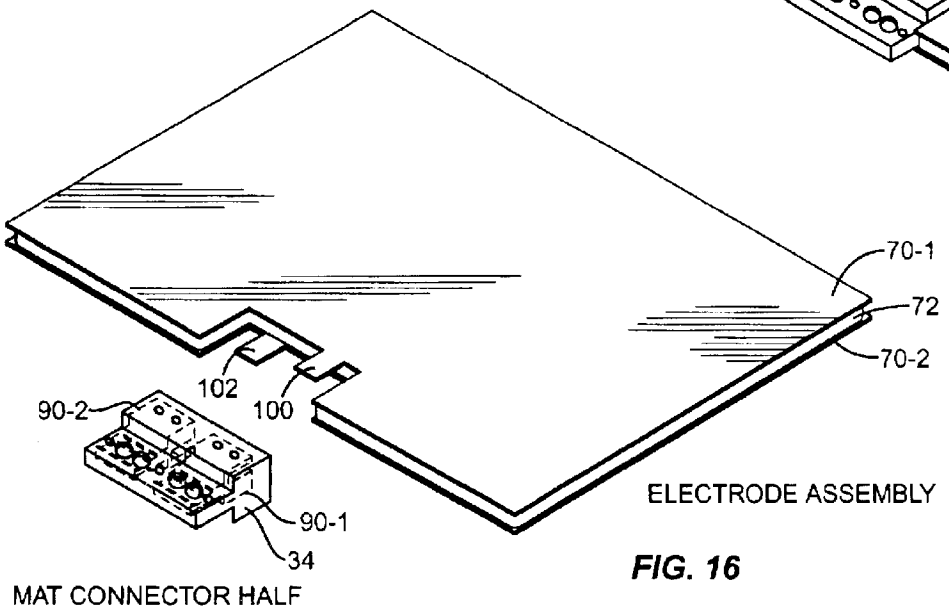
FIG. 16 is a diagram of an exemplary mat connector shown before attachment to exemplary mat electrodes.

FIGS. 16 and 17 illustrate this more clearly. FIG. 16 specifically illustrates upper and lower mat electrodes 70-1 and 70-2 separated by a spacer 72 that extends around a perimeter of the vertically spaced apart electrode 70. Upper electrode 70-1 includes a first tab 100 that projects into the recessed area that will be occupied by the mounted mat connector 34 and, likewise, the lower electrode 102 includes a similar tab 102 that projects into the same recessed area but that is offset both laterally and vertically from tab 100. For this arrangement, then, the exemplary mat connector 34 includes two contact blocks 90-1 and 90-2 that are fixed within the body of mat connector 34.

While not explicitly illustrated in FIG. 16, the backside of each connector block 90 includes a slot to receive at least a portion of either tab 100 or tab 102 such that the mating connector 34 essentially slides onto the tab projections. Once mounted in this fashion, the previously illustrated set-screws 92 may be used to secure mat connector 34 to mat electrodes 70. That mounted configuration is illustrated in FIG. 17.

Figure 18:
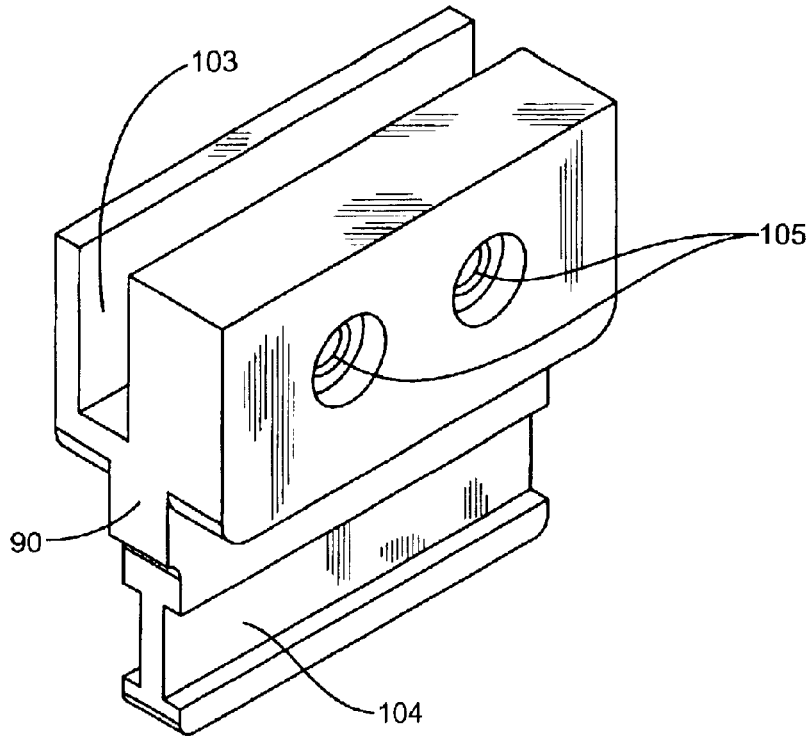
FIG. 18 is a diagram of an exemplary connection block, one or more of which may be carried within the body of an exemplary mat connector to provide for mechanical and electrical interconnection with the mat electrode(s).

FIG. 18 illustrates an exemplary embodiment for solid contact blocks 90 that may be encased within the body of mat connector 34. From the illustration, one sees that an exemplary solid contact block 90 includes a receiving slot 103 to receive the corresponding mat electrode tab 100 or 102, and further includes a contacting face 104 and one or more set-screw holes 105. As noted, set-screw holes 105 may be used to mechanically and electrically fasten the contact block 90 to one of the mat electrodes 70. In turn, the contacting face 104 provides an electrically conductive surface that is exposed through the contact openings located within the mating connector face of mat connector 34, which openings were generally illustrated as contacts 52 earlier herein. Those openings thus provide clearance for the spring contacts 56 of cable connector 40 to electrically and mechanically engage with the contact blocks 90.

Figure 19:
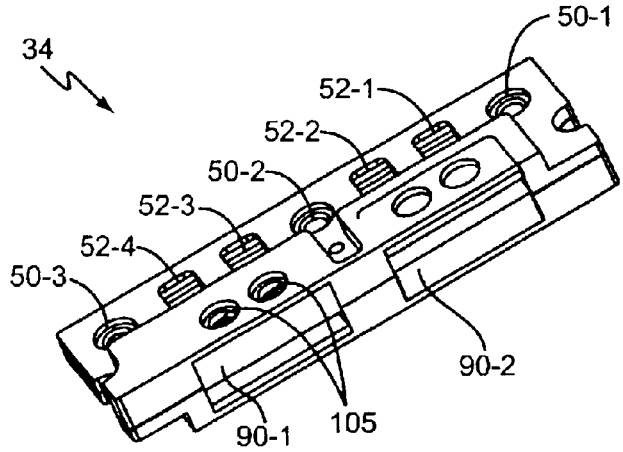
FIG. 19 is a diagram of an exemplary mat connector body, which may include one or more connector blocks.
Figure 20:
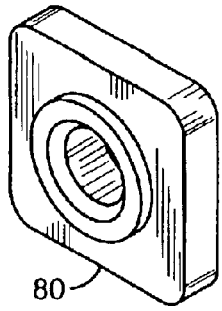
FIG. 20 is a diagram of an exemplary molded-in nut that may be positioned within the body of the mat connector to provide a threaded mounting hold for fastening the cable connector to the mat connector.

This arrangement is more clearly illustrated in FIG. 19. The insertion of molded-in contact blocks 90-1 and 90-2 within the molded body of mat connector 34 is more clearly shown. In a related illustration, FIG. 20 shows an exemplary embodiment of the molded-in nut that may be molded into mounting holes 50 of mat connector 34 to provide a mechanism for compressively mounting the cable connector to mat connector 34 via threaded fasteners 58. Note that the body of connector 34 may include both top and bottom side openings into the set-screw holes 105 of internal contact blocks 90, although not all such openings necessarily will have an installed set screw. Any unused set-screw hole 105 generally will fill with mat molding compound during the molding of mat 32 and such filling helps sealing and securing the inset area in and around mat connector 34.

Figure 21:
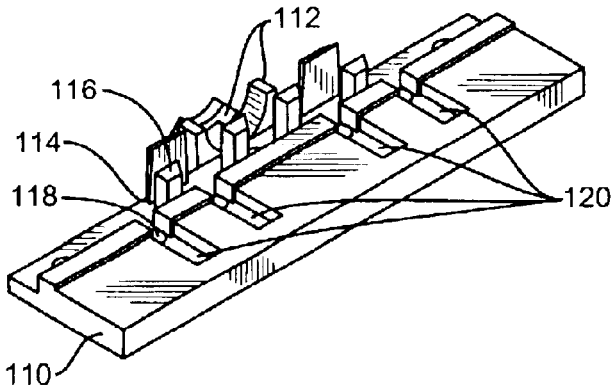
FIG. 21 is a diagram of exemplary cable connector body used to form an exemplary cable connector for attachment to the mat connector.
Figure 22:
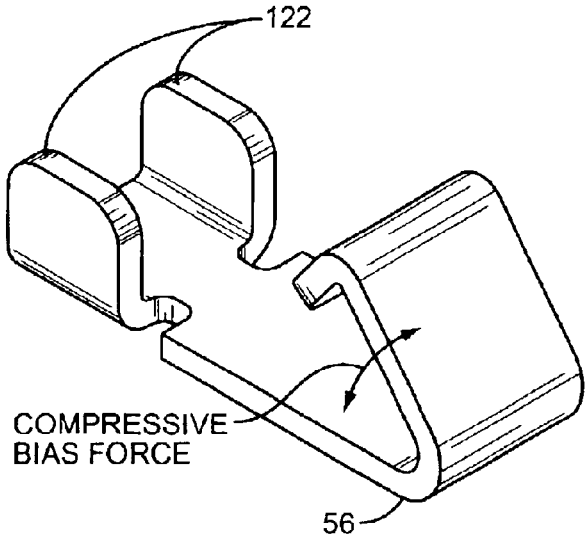
FIG. 22 is a diagram of an exemplary spring contact, which may be included in the cable connector to provide a biased contact engagement when the cable connector is mounted to the mat connector.

Like mat connector 34, cable connector 40 may be formed as a molded plastic part that includes one or more internal components and/or structural features. FIG. 21 illustrates an exemplary embodiment for a portion of cable connector 40 wherein one sees a base piece 110 that may be a glass filled plastic such as nylon. Base 110 includes a cable support 112, wire channels 114, molding posts 116, overmolding holes 118, and contact finger channels 120. FIG. 22 illustrates an exemplary embodiment of the spring contact fingers 56 which include a rear wire-crimping portion 122 to capture one or more electrical conductors connected to the finger 56. One contact finger 56 is placed into each contact finger channel 120. Contact fingers 56 may be secured in the channels 120 by press fitting them into the channels 120, and then overmolding the entire assembly (e.g., fingers 56, cable conductors, etc.) additional plastic material to form a completed cable connector 40.

Of course, the present invention is not limited to the particular structural details of cable connector 40, and it should be understood that such details may be varied as needed or desired without departing from the scope of the present invention. Indeed, the present invention is directed to a pressure-sensitive mat system that includes a detachable cable assembly having a cable connector 40 that detachably mates with a mat connector. In exemplary embodiments, the mat connector 34 is recessed within an inset area 36 of mat 32 such that the mated cable connector 40 advantageously remains within the dimensional envelope of the mat 32 while still providing a high-integrity, watertight connection.

Thus, the foregoing description and accompany illustrations are exemplary and not limiting. Indeed, the present invention is limited only by the following claims and their reasonable equivalents.

What is claimed is:

1. A pressure-sensitive mat system comprising:

a pressure-sensitive mat comprising an outer mat covering that includes an inset area along a mat edge, and further comprising a recessed mat connector positioned within the inset area; and a detachable cable assembly comprising a cable having a cable connector at one end of the cable;

said cable connector comprising a connector body sized to fit within the inset area of the mat so that the cable connector remains within a dimensional envelope of the mat when mated with the mat connector.

2. The mat system of claim 1, further comprising one or more mat trim strips to fit substantially flush edgewise along one or more edges of the mat, including the mat edge that includes the mat connector.

3. The mat system of claim 2, wherein the mat trim strip corresponding to the mat edge that includes the mat connector includes a routing passage for the cable.

4. The mat system of claim 1, wherein the mat further includes a second mat connector positioned in a second inset area along the same or a different mat edge, said second mat connector to be used in series connecting together multiple mats.

5. The mat system of claim 4, further comprising a second cable assembly that includes a cable connector at each cable end to be used in series connecting together two mats.

6. The mat system of claim 1, wherein the mat connector includes a vent in fluid communication with a mat interior.

7. The mat system of claim 6, wherein vent of the mat connector terminates in a mounting hole within the mat connector such that mounting the cable connector to the mat connector seals the vent.

8. The mat system of claim 1, wherein mat connector includes a first connector mating face with one or more exposed electrode contacts, and wherein the cable connector includes a second connector mating face with one or more contact fingers that electrically connect with the one or more exposed electrode contacts when the cable connector is mated with the mat connector.

9. The mat system of claim 8, further comprising a gasket to be interposed between the first and second mating faces of the mat and cable connectors to thereby establish a seal around the contact fingers and the electrode contacts.

10. The mat system of claim 9, wherein the cable connector mounts to the mat connector via threaded fasteners such that the first and second connector mating faces compressively engage the interposed gasket when the cable connector is mounted to the mat connector.

11. The mat system of claim 1, wherein the mat includes one or more interior electrodes to sense force exerted against an exterior surface of the mat, and wherein portions of the one or more electrodes project into the inset area of the recessed connector such that the mat connector attaches directly to the one or more interior electrodes.

12. The mat system of claim 11, wherein the exterior surface of the mat is a flexible skin that is molded around the interior electrodes and a portion of the mat connector.

13. A pressure-sensitive mat system comprising:

a pressure-sensitive mat including at least one mat connector;

said mat connector including a vent that opens into an interior of the mat; and a detachable cable assembly including a cable connector to mate with the mat connector;

said cable and mat connectors configured such that the vent is open if the cable connector is not mounted to the mat connector and is closed if the cable connector is mounted to the mat connector.

14. A pressure-sensitive mat system comprising:

a pressure-sensitive mat including at least one mat connector; and a detachable cable assembly including a cable connector to mate with the mat connector;

said cable connector including one or more spring contacts to compressively engage one or more contacts of the mat connector when the cable connector is mated to the mat connector.

15. The pressure-sensitive mat system of claim 14, wherein the mat connector includes one or more threaded mounting holes and the cable connector includes one or more corresponding mounting holes to support mounting the cable connector to the mat connector via one or more threaded fasteners.

16. A pressure-sensitive mat system comprising:

a pressure-sensitive mat including at least one mat connector that includes a first mating face having a contact area with one or more contacts;

a gasket; and a detachable cable assembly including a cable connector to mate with the mat connector, said cable connector including a second mating face having a contact area with one or more contacts;

said gasket being interposed between the first and second mating faces such that mounting the cable connector to the mat connector compressively engages the gasket between the first and second mating faces and substantially seals the contact areas of the mat and cable connectors.

17. The pressure-sensitive mat system of claim 16, wherein the gasket is integrally attached to one of the mat connector or the cable connector.

* * * * *